US009640008B2

(12) United States Patent
Kobayashi

(10) Patent No.: US 9,640,008 B2
(45) Date of Patent: May 2, 2017

(54) CASH TRANSACTION MACHINE

(71) Applicant: Oki Electric Industry Co., Ltd., Tokyo (JP)

(72) Inventor: Yoshinari Kobayashi, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 15/110,983

(22) PCT Filed: Oct. 27, 2014

(86) PCT No.: PCT/JP2014/078512
§ 371 (c)(1),
(2) Date: Jul. 12, 2016

(87) PCT Pub. No.: WO2015/133001
PCT Pub. Date: Sep. 11, 2015

(65) Prior Publication Data

US 2016/0343191 A1 Nov. 24, 2016

(30) Foreign Application Priority Data

Mar. 3, 2014 (JP) ..... 2014-040746

(51) Int. Cl.
*G07F 7/00* (2006.01)
*G07D 11/00* (2006.01)
*G07F 19/00* (2006.01)

(52) U.S. Cl.
CPC ..... *G07D 11/0075* (2013.01); *G07D 11/0066* (2013.01); *G07D 11/0078* (2013.01); *G07D 11/0084* (2013.01); *G07F 19/202* (2013.01)

(58) Field of Classification Search
CPC .. G07D 7/00; G07D 11/0003; G07D 11/0051; G07D 11/0069; G07D 11/0084; G07D 2211/00; G07F 10/00; G07F 10/20; G07F 10/202
See application file for complete search history.

(56) References Cited

U.S. PATENT DOCUMENTS

2004/0205025 A1 10/2004 Takeuchi et al.
2010/0174403 A1 7/2010 Takeuchi et al.
2012/0012437 A1* 1/2012 Matsumoto ..... G07D 9/00 194/342
2012/0243056 A1* 9/2012 Yamaguchi ..... G07D 11/0069 358/462

(Continued)

FOREIGN PATENT DOCUMENTS

JP H04-293191 A 10/1992
JP H07-220142 A 8/1995

(Continued)

*Primary Examiner* — Mark Beauchaine
(74) *Attorney, Agent, or Firm* — Rabin & Berdo, P.C.

(57) ABSTRACT

To enhance the functionality of an automated cash transaction machine. An automated cash transaction machine 1 is disposed with a currency bill deposit/withdrawal unit 16 that accepts currency bills from outside, a discriminating unit 18 that discriminates the authenticity of the currency bills and also reads their serial numbers, and a receipt issuing slot 8 and an operation display unit 6 that present, to a customer for each deposit transaction, the serial number of a currency bill judged to be a fake bill by the discriminating unit 18.

18 Claims, 15 Drawing Sheets

(56) References Cited

U.S. PATENT DOCUMENTS

| | | | | |
|---|---|---|---|---|
| 2014/0083814 | A1 | 3/2014 | Nomura et al. | |
| 2014/0238815 | A1* | 8/2014 | Iwamura ..... | G07F 7/04<br>194/206 |
| 2015/0170119 | A1 | 6/2015 | Adachi et al. | |

FOREIGN PATENT DOCUMENTS

| | | | |
|---|---|---|---|
| JP | 2004-310594 | A | 11/2004 |
| JP | 2010-108160 | A | 5/2010 |
| JP | 2012-203666 | A | 10/2012 |
| JP | 2014-010799 | A | 1/2014 |

* cited by examiner

CASH TRANSACTION MACHINE

TECHNICAL FIELD

The present invention relates to a cash transaction machine and is suitably applied, for example, to an automated cash transaction machine (ATM: Automatic Teller Machine) to which media such as currency bills are input and which performs desired transactions.

BACKGROUND ART

Conventionally, automated cash transaction machines used in financial institutions and stores have been configured, for example, to allow customers to deposit cash such as currency bills and coins into them and dispense cash to customers in accordance with the details of the transactions with the customers.

There are automated cash transaction machines which, like the one described in Japanese Patent Application Laid-open (JP-A) No. 2010-108160, for example, include a currency bill deposit/withdrawal unit that accepts currency bills from and dispenses currency bills to customers, a discriminating unit that discriminates the denominations and authenticity of input currency bills and also identifies the serial numbers (consecutive numbers) of the currency bills, a temporary holding unit that temporarily holds the input currency bills, a transport unit that transports the currency bills, and currency bill storage receptacles that store the currency bills according to their denominations.

SUMMARY OF INVENTION

Technical Problem

In this kind of automated cash transaction machine, in a case where fake bills have been input in multiple transactions, it is desired to identify which fake bills were input in which transactions.

The present invention has been made in consideration of the above point and proposes a cash transaction machine whose functionality can be enhanced.

Solution to Problem

In order to solve this problem, a cash transaction machine of the present invention comprises: a deposit unit that accepts currency bills from outside; a discriminating unit that discriminates the authenticity of the currency bills; a serial number reading unit that reads the serial numbers of the currency bills; and a presentation unit that presents, to a customer for each deposit transaction, the serial number of a currency bill judged to be a fake bill by the discriminating unit.

This cash transaction machine can allow the transaction in which a fake bill was input to be identified on the basis of the serial number of the fake bill.

Advantageous Effects of Invention

According to the present invention, the invention can allow the transaction in which a fake bill was input to be identified on the basis of the serial number of the fake bill. In this way, the present invention can realize a cash transaction machine whose functionality can be enhanced.

DESCRIPTION OF EMBODIMENTS

Modes for carrying out the invention (hereinafter called embodiments) will be described below using the drawings.

1. First Embodiment

1-1. Configuration of Automated Cash Transaction Machine

Figure 1:
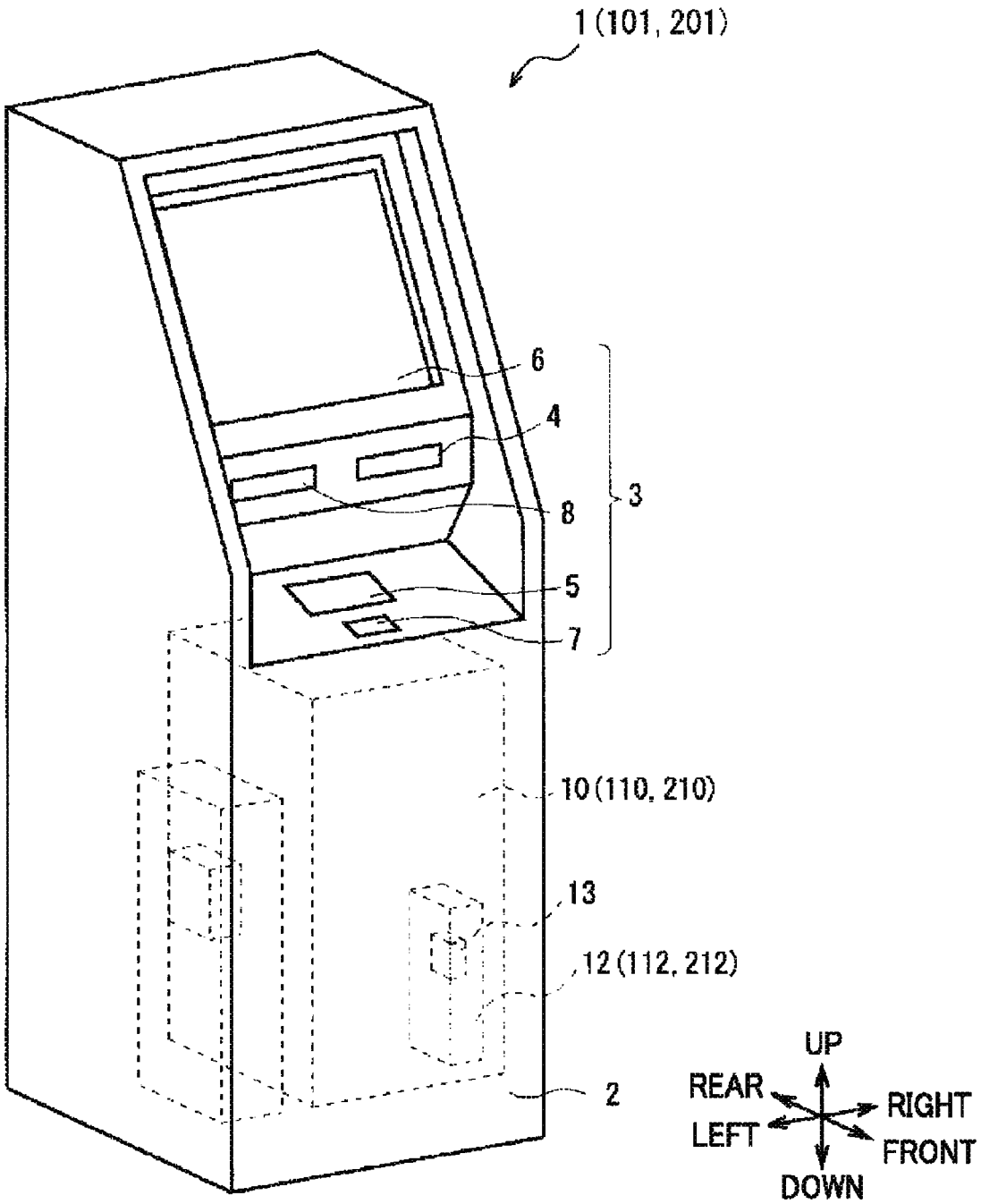
FIG. 1 is a perspective view showing the configuration of an automated cash transaction machine.

An automated cash transaction machine 1, whose outer appearance is shown in FIG. 1, is configured around a box-like housing 2, is installed in a financial institution, for example, and is configured to perform cash-related transactions such as deposit transactions and withdrawal transactions with customers.

The housing 2 has a shape wherein the section from the upper portion of its front surface to its upper surface—that is, the place where it is easy for a customer to input currency bills and operate a touch panel in a state in which the customer faces the front side of the housing 2—is obliquely cut out, and a customer service unit 3 is disposed in this section. The customer service unit 3 is disposed with a card insertion/ejection slot 4, a deposit/withdrawal opening 5, an operation display unit 6, a numerical keypad 7, and a receipt issuing slot 8, and is configured to directly exchange cash and receipts with customers and also notify customers of transaction-related information and accept operation instructions.

The card insertion/ejection slot 4 is a section into or from which various types of cards such as cash cards are inserted or ejected. A card processing unit (not shown in the drawings) that reads account numbers and so forth magnetically recorded in various types of cards is disposed on the far side of the card insertion/ejection slot 4. The deposit/withdrawal opening 5 is a section to which currency bills deposited by customers are input and currency bills withdrawn by customers are dispensed, and is opened or closed by driving a shutter. The operation display unit 6 comprises an integrated liquid crystal display (LCD), which displays operation screens during transactions, and touch panel, by which transaction types are selected and personal identification numbers, transaction amounts, and so forth are input. The numerical keypad 7 comprises physical keys for accepting the input of the numbers "0" to "9", and is used when inputting personal identification numbers, transaction amounts, and so forth. The receipt issuing slot 8 is a section that issues receipts on which transaction details are printed when a transaction process ends. A receipt processing unit 30 (FIG. 2) that prints transaction details and so forth on the receipts is disposed on the far side of the receipt issuing slot 8.

Disposed inside the housing 2 are a main control unit (not shown in the drawings) that centrally controls the entire automated cash transaction machine 1, a currency bill deposit/withdrawal machine 10 that performs various types of processes relating to currency bills, and a journal unit 32.

The journal unit 32 is configured by a hard disk drive, for example, stores the transaction details of each transaction, and saves the transaction details as journal information.

Below, the side of the automated cash transaction machine 1 that customers face will be defined as the front side, the opposite side of the front side will be defined as the rear side, the right side and the left side as seen from the standpoint of customers facing the front side will be defined as the right side and the left side, respectively, and the upper side and the lower side will be defined as such.

1-2. Internal Configuration of Currency Bill Deposit/Withdrawal Machine

Figure 2:
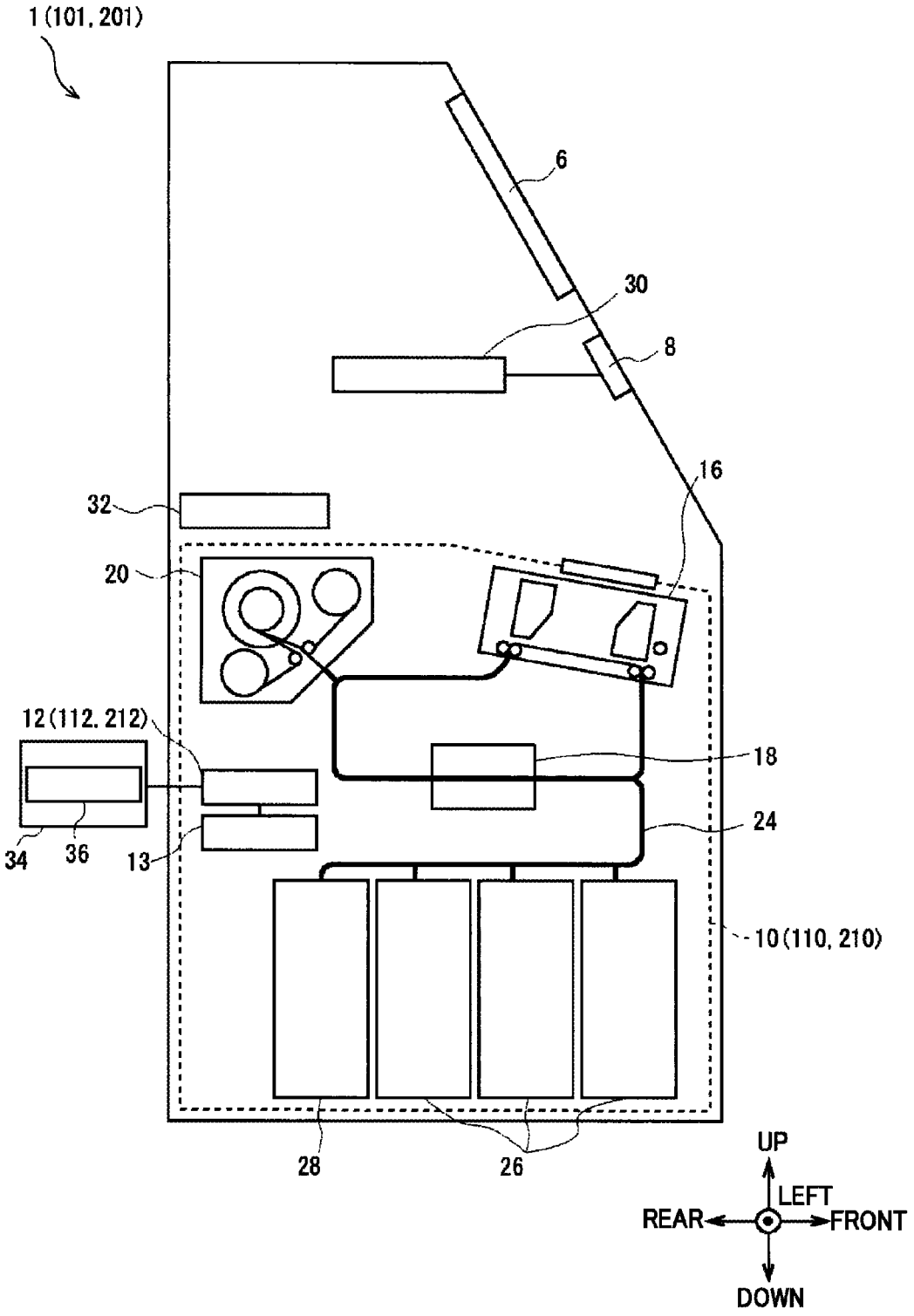
FIG. 2 is a left side view showing the configuration of a currency bill deposit/withdrawal machine.

As shown in FIG. 2, a control unit 12 centrally controls each part of the currency bill deposit/withdrawal machine 10 (a currency bill deposit/withdrawal unit 16, a discriminating unit 18, a temporary holding unit 20, a transport unit 24, currency bill storage receptacles 26, and a fake bill receptacle 28).

The control unit 12 is configured around a central processing unit (CPU) not shown in the drawings, controls each part and performs various types of processes such as deposit transactions and withdrawal transactions by reading and executing a predetermined program from a storage unit 13 comprising a read-only memory (ROM), a random access memory (RAM), a hard disk drive, and/or a flash memory. Furthermore, the control unit 12 is connected via an interface unit not shown in the drawings to a host computer 34, which is disposed outside the automated cash transaction machine 1 and has a storage unit 36, and exchanges various types of data with the host computer 34.

The storage unit 13 stores, together with transaction information, discrimination results obtained by the discriminating unit 18 discriminating currency bills and identification results obtained by identifying the serial numbers of the currency bills.

Furthermore, the currency bill deposit/withdrawal unit 16, the discriminating unit 18, which determines the denominations and authenticity of the currency bills and also reads and identifies the serial numbers assigned to the currency bills, and the temporary holding unit 20, which temporarily holds deposited currency bills and so forth, are disposed on the upper side of the inside of the currency bill deposit/withdrawal machine 10.

The transport unit 24 transports rectangular currency bills along their short side direction along a transport path indicated by the bold lines in the drawing by means of rollers and belts not shown in the drawings. The transport unit 24 transports the currency bills in such a way as to insert them in the front and rear direction through the discriminating unit 18 and connects the rear side of the discriminating unit 18 to the temporary holding unit 20 and the currency bill deposit/withdrawal unit 16. Furthermore, the transport unit 24 connects the front side of the discriminating unit 18 to the currency bill deposit/withdrawal unit 16, the currency bill storage receptacles 26, and the fake bill receptacle 28.

The discriminating unit 18, while transporting the currency bills inside, uses an optical element and/or a magnetic detection element to discriminate the denominations and authenticity of, as well as the extent of damage (fitness) to, the currency bills, and notifies the control unit 12 of the discrimination results. Furthermore, the discriminating unit 18 reads and identifies, from image data of the imaged currency bills, the serial numbers that are currency bill identification information configured by alphanumeric characters assigned to each currency bill and printed beforehand on one side of the currency bills, and notifies the control unit 12 of the identified characters as the identification results. In accordance with this the control unit 12 stores the acquired discrimination results and identification results together with the transaction information in the storage unit 13 and also changes the destination to which the currency bills are transported in accordance with the discrimination results and identification results.

The temporary holding unit 20 temporarily holds the currency bills that a customer has input to the currency bill deposit/withdrawal unit 16 at the time of a deposit and temporarily holds, until the deposit is confirmed, normal bills discriminated to be authentic currency bills by the discriminating unit 18.

Furthermore, the currency bill storage receptacles 26, which are differentiated by denomination and store currency bills determined to be normal bills, and the fake bill receptacle 28, which stores currency bills determined to be counterfeit bills, are disposed at the lower side of the inside of the currency bill deposit/withdrawal machine 10. The currency bill storage receptacles 26 accept and store, by means of a storing and dispensing mechanism, currency bills transported thereto from the transport unit 24 and also dispense and supply to the transport unit 24 the stored currency bills.

Having this configuration, the automated cash transaction machine 1 performs a currency bill deposit process in which the main control unit (not shown in the drawings) and the control unit 12 control each part on the basis of the currency bill discrimination results and identification results obtained by the discriminating unit 18.

That is, when, at the time of a deposit transaction, a deposit transaction is selected by a customer via the operation display unit 6 and currency bills are input to the deposit/withdrawal opening 5, the automated cash transaction machine 1 transports the input currency bills one bill at a time from the currency bill deposit/withdrawal unit 16 to the discriminating unit 18. Here, the automated cash transaction machine 1 transports to and temporarily stores in the temporary holding unit 20 currency bills determined to be normal bills on the basis of the discrimination results and identification results of the discriminating unit 18. At the same time, the automated cash transaction machine 1 transports to and stores in the fake bill receptacle 28 currency bills determined to be counterfeit bills. Thereafter, when the deposit amount is confirmed by the customer, the automated cash transaction machine 1 transports the currency bills stored in the temporary holding unit 20 to the currency bill storage receptacles 26 and retains those currency bills in the currency bill storage receptacles 26 in accordance with their denominations. In this way, by transporting the currency bills determined to be counterfeit bills to the fake bill receptacle 28, the automated cash transaction machine 1 sorts the counterfeit bills from the normal bills and retains the counterfeit bills.

1-3. Deposit Process

Figure 3:
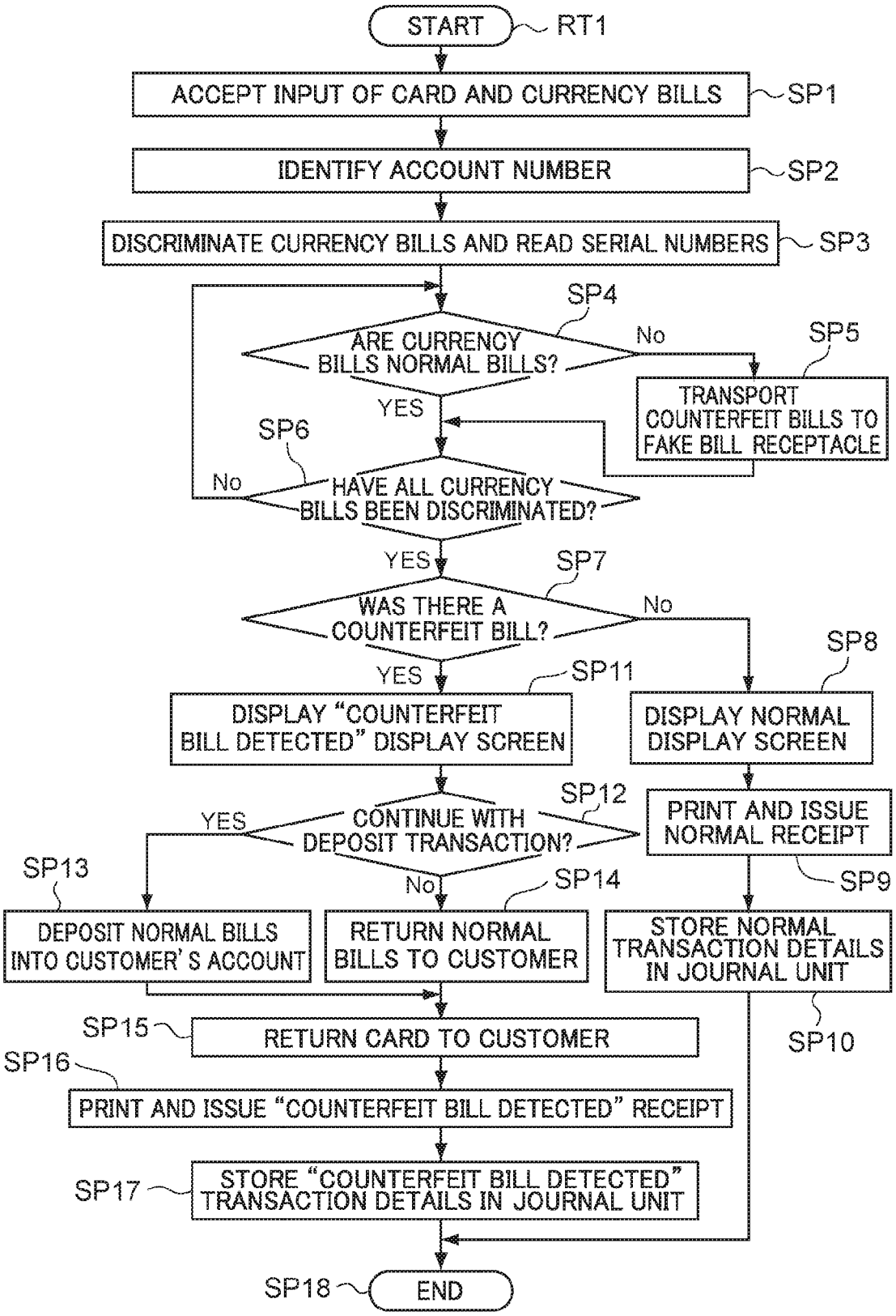
FIG. 3 is a flowchart showing a deposit process routine.

Next, a specific process routine of the deposit process performed by the automated cash transaction machine 1 will be described in detail using the flowchart shown in FIG. 3.

When a deposit transaction is selected by a customer via the operation display unit 6, the control unit 12 of the currency bill deposit/withdrawal machine 10 starts a deposit process routine RT1 by reading and executing a deposit process program from the storage unit 13, and then the control unit 12 moves to step SP1.

In step SP1 the control unit 12 opens the shutter of the card insertion/ejection slot 4 and the shutter of the deposit/withdrawal opening 5, and displays on the operation display unit 6 a prompt to input various types of cards and currency bills. Then, the control unit 12 accepts the input of a card and currency bills and closes the shutter of the card insertion/ejection slot 4 and the shutter of the deposit/withdrawal opening 5, and then the control unit 12 moves to step SP2.

In step SP2 the control unit 12 identifies, by means of the card processing unit not shown in the drawings, the customer's account number recorded in the card, and then the control unit 12 moves to step SP3.

In step SP3 the control unit 12 transports the currency bills from the currency bill deposit/withdrawal unit 16 to the discriminating unit 18 and, in the discriminating unit 18, discriminates the currency bills to acquire discrimination results and also reads the serial numbers to acquire identification results, and then the control unit 12 moves to step SP4.

In step SP4 the control unit 12 determines whether or not the currency bills are normal bills on the basis of the discrimination results acquired from the discriminating unit 18. Here, if an affirmative result is obtained, the control unit 12 transports the currency bill to temporary holding unit 20, and then the control unit 12 moves to step SP6. On the other hand, if a negative result is obtained in step SP4, this means that the currency bill has been discriminated to be a counterfeit bill, and in this case the control unit 12 moves to step SP5 where it transports the currency bill to the fake bill receptacle 28, and then the control unit 12 moves to step SP6.

In step SP6 the control unit 12 determines whether or not all the currency bills input to the currency bill deposit/withdrawal unit 16 have been discriminated; the control unit 12 repeats the processes of steps SP4 to SP6 until an affirmative result is obtained, and when an affirmative result is obtained, the control unit 12 moves to step SP7.

Figure 4:
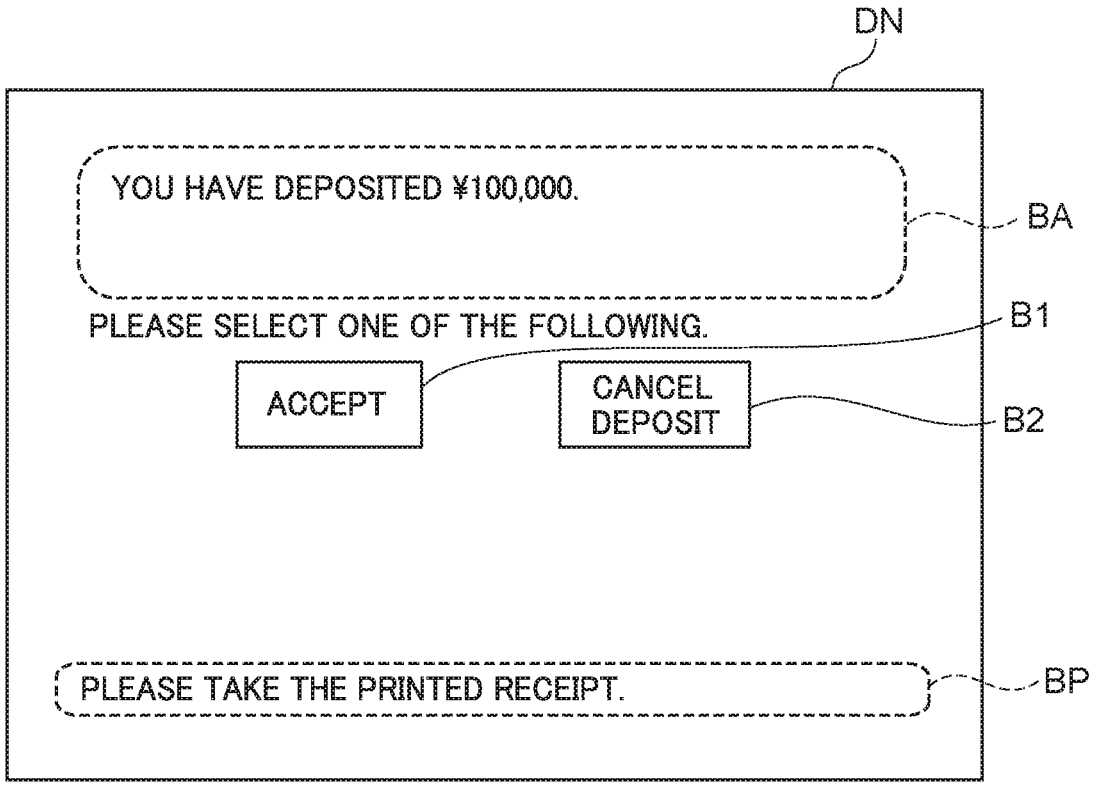
FIG. 4 is a schematic diagram showing a normal display screen.

In step SP7 the control unit 12 determines whether or not there was a counterfeit bill among the input currency bills. Here, if a negative result is obtained, the control unit 12 moves to step SP8 where it displays on the operation display unit 6 a normal display screen DN shown in FIG. 4. The normal display screen DN has a normal amount display field BA that shows the amount deposited by the customer, an "accept" button B1, a "cancel deposit" button B2, and a normal receipt prompt display field BP that prompts the customer to take the receipt. When the "accept" button B1 is selected by the customer, the control unit 12 moves to step SP9.

Figure 5:
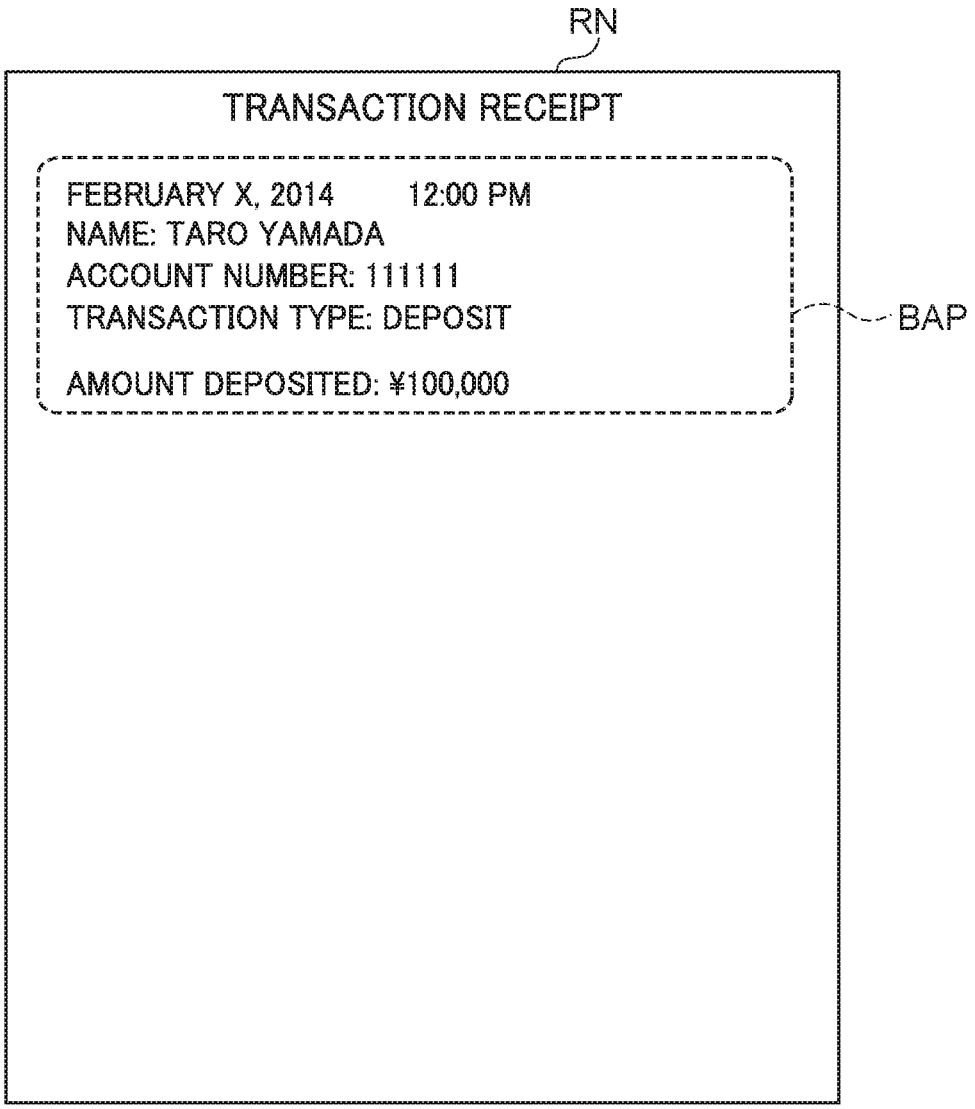
FIG. 5 is a schematic diagram showing a normal receipt.

In step SP9 the control unit 12 uses the receipt processing unit 30 to print the receipt and issues a normal receipt RN shown in FIG. 5 from the receipt issuing slot 8, and then the control unit 12 moves to step S10. The normal receipt RN has a normal transaction details printing field BAP, and shown in this normal transaction details printing field BAP are the date when the transaction occurred, the customer's name, the customer's account number, the transaction type, and the amount deposited by the customer.

Figure 6:
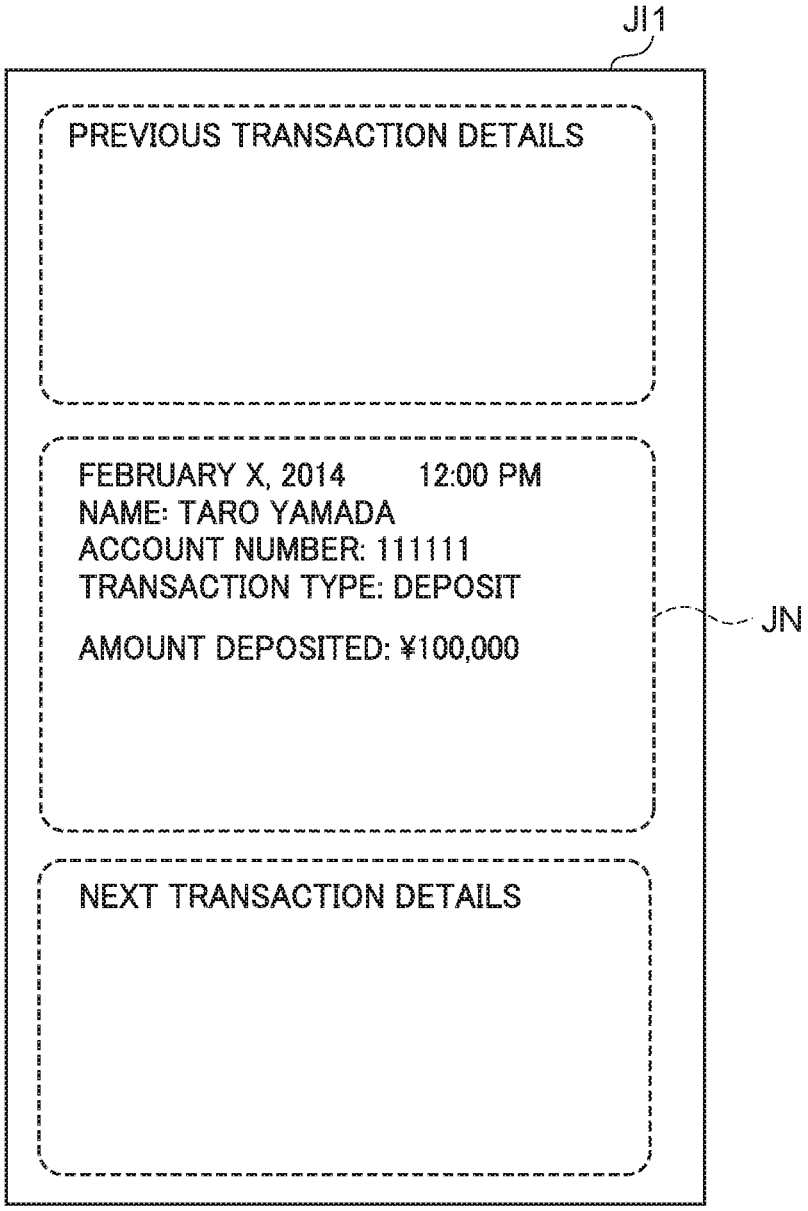
FIG. 6 is a schematic diagram showing normal journal information.

In step SP10 the control unit 12 stores normal transaction details JN shown in FIG. 6 in journal information JI in the journal unit 32, and then the control unit 12 moves to step SP18 where it ends the deposit process routine RT1. The normal transaction details JN are the same details as those in the normal transaction details printing field BAP in the normal receipt RN (FIG. 5).

On the other hand, if an affirmative result is obtained in step SP7, this means that there was a counterfeit bill among the input currency bills, and in this case the control unit 12 moves to step SP11.

Figure 7:
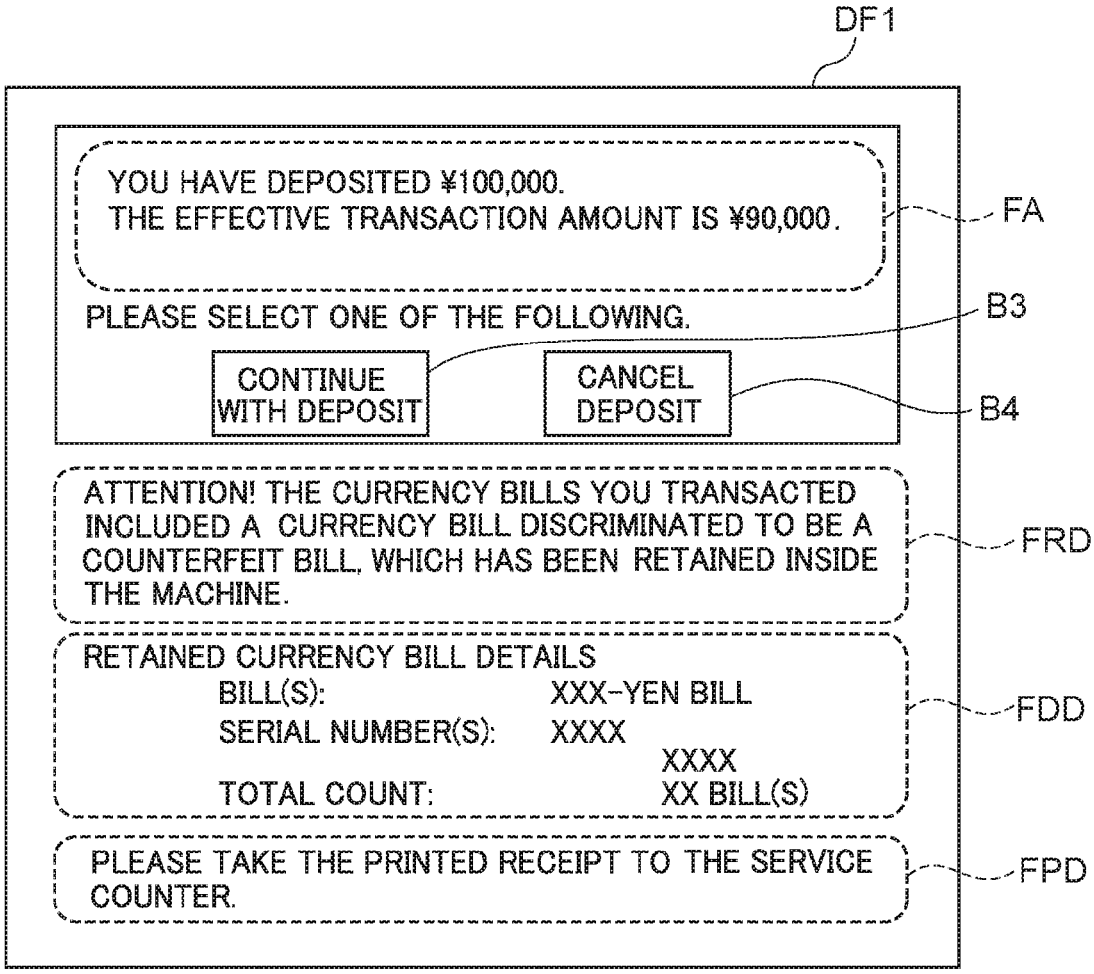
FIG. 7 is a schematic diagram showing a "counterfeit bill detected" display screen according to a first embodiment.

In step SP11 the control unit 12 displays on the operation display unit 6 a "counterfeit bill detected" display screen DF1 shown in FIG. 7, and then the control unit 12 moves to step SP12. The "counterfeit bill detected" display screen DF1 has a "counterfeit bill detected" amount display field FA, a "continue with deposit" button B3, a "cancel deposit" button B4, a counterfeit bill detection display field FRD, a counterfeit bill details display field FDD, and a "counterfeit bill detected" receipt prompt display field FPD. The "counterfeit bill detected" amount display field FA shows the amount deposited by the customer and the effective transaction amount. The counterfeit bill detection display field FRD shows that currency bills discriminated to be counterfeit bills have been isolated in the fake bill receptacle 28. The counterfeit bill details display field FDD shows the denominations, serial numbers, and count of the currency bills discriminated to be counterfeit bills. The "counterfeit bill detected" receipt prompt display field FPD prompts the customer to take the receipt to the service counter.

In step SP12 the control unit 12 determines whether the "continue with deposit" button B3 has been pressed or the "cancel deposit" button B4 has been pressed by the customer via the operation display unit 6. Here, if the "continue with deposit" button B3 has been pressed, this means that the customer wants to continue with the deposit transaction, and in this case the control unit 12 moves to step SP13 where it transports to the currency bill storage receptacles 26 only the normal bills and deposits to the customer's account only the total amount of the currency bills determined to be normal bills, and then the control unit 12 moves to step SP15.

On the other hand, if the "cancel deposit" button B4 has been pressed in step SP12, this means that the customer does not want to continue with the deposit transaction, and in this case the control unit 12 moves to step SP14 where it transports to the currency bill deposit/withdrawal unit 16 and returns to the customer only the normal bills, and then the control unit 12 moves to step SP15.

In step SP15 the control unit 12 ejects the card from the card insertion/ejection slot 4 to return the card to the customer, and then the control unit 12 moves to step SP16.

Figure 8:
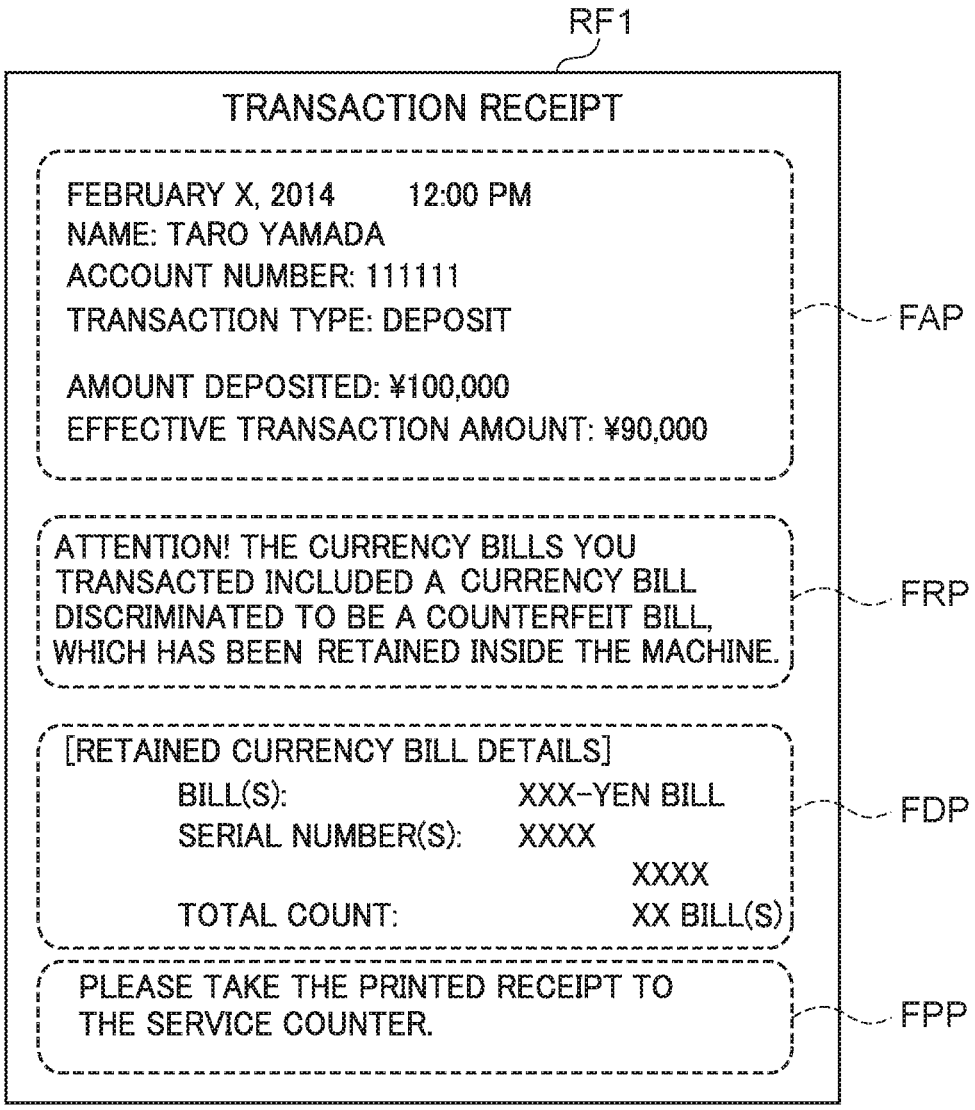
FIG. 8 is a schematic diagram showing a "counterfeit bill detected" receipt according to the first embodiment.

In step SP16 the control unit 12 uses the receipt processing unit 30 to print a receipt and issues a "counterfeit bill detected" receipt RF1 shown in FIG. 8 from the receipt issuing slot 8, and then the control unit 12 moves to step SP17. The "counterfeit bill detected" receipt RF1 has a "counterfeit bill detected" transaction details printing field FAP in which are shown the date when the transaction occurred, the customer's name, the customer's account number, the transaction type, the amount deposited by the customer, and the effective transaction amount, a counterfeit bill detection printing field FRP that shows that currency bills discriminated to be counterfeit bills were isolated in the fake bill receptacle 28, a counterfeit bill details printing field FDP that shows the denominations, serial numbers, and count of the currency bills discriminated to be counterfeit bills, and a "counterfeit bill detected" receipt prompt printing field FPP that prompts the customer to take the receipt to the service counter.

Figure 9:
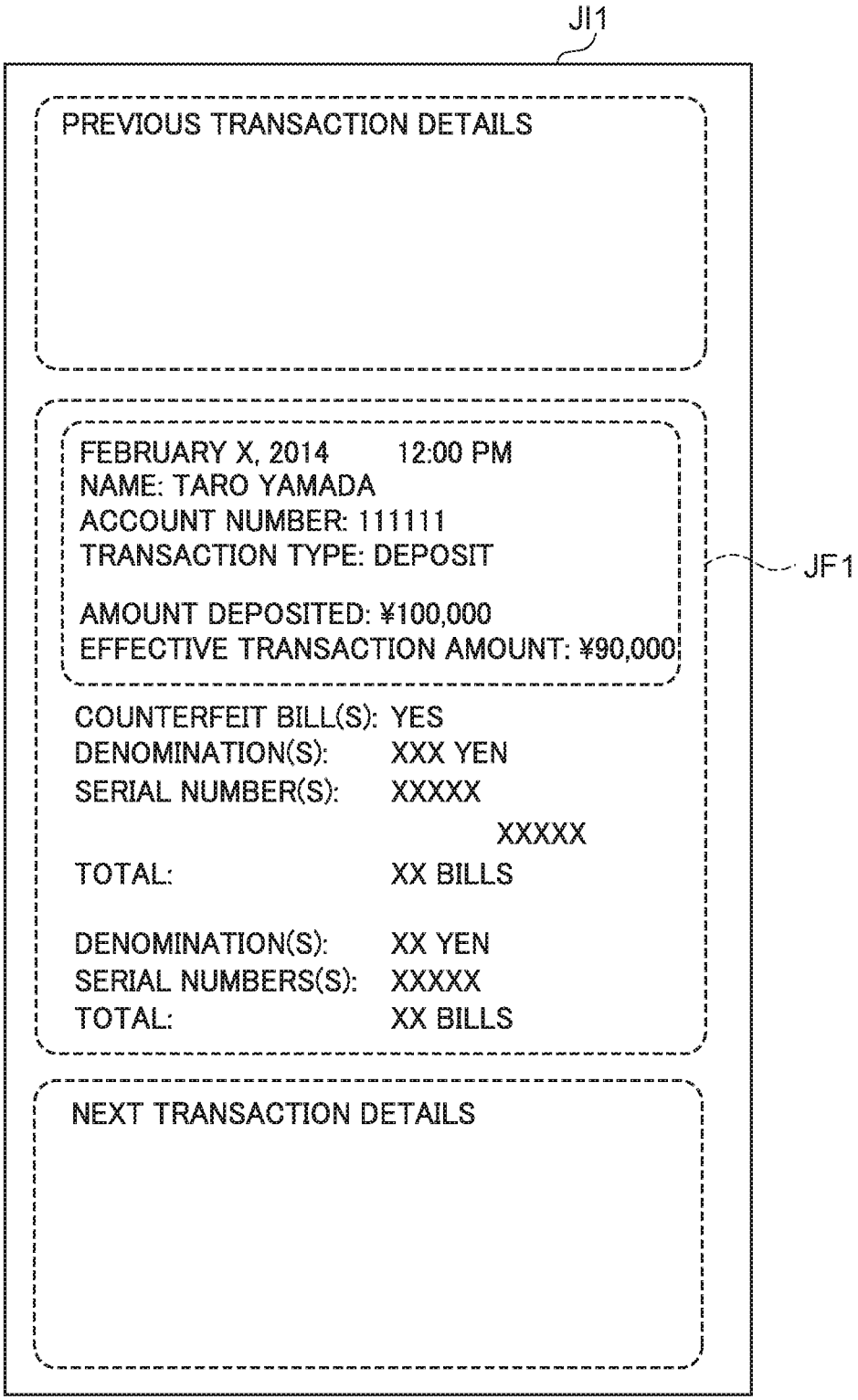
FIG. 9 is a schematic diagram showing journal information when a counterfeit bill is detected according to the first embodiment.

In step SP17 the control unit 12 stores "counterfeit bill detected" transaction details JF1 shown in FIG. 9 in the journal information JI in the journal unit 32, and then the control unit 12 moves to step SP18 where it ends the deposit process routine RT1. The "counterfeit bill detected" transaction details JF1 are the same as those in the "counterfeit bill detected" transaction details printing field FAP and the counterfeit bill details printing field PUP in the "counterfeit bill detected" receipt RF1.

The customer takes the issued "counterfeit bill detected" receipt RF1 to the service counter and presents it to a person-in-charge. The person-in-charge removes the customer's currency bills from the automated cash transaction machine 1 and disposes of them in a manner prescribed by law or the bank.

1-4. Advantageous Effects

Conventionally, automated cash transaction machines have been installed outside bank branches, and when, in a case where currency bills deposited by multiple customers have been determined to be counterfeit bills but there was a customer who did not report to the person-in-charge at the service counter of the bank, the person-in-charge later removes the customers' currency bills from the automated cash transaction machine, there has been the potential for counterfeit bills accepted in a transaction with another customer apart from those customers to be mixed in. In that case, it ends up becoming difficult to identify the currency bills that were deposited by that customer.

Furthermore, in order to avoid a situation where currency bills discriminated to be counterfeit bills become mixed with currency bills deposited by another customer, a method that suspends transactions by the automated cash transaction machine to preserve the state prior to moving the counterfeit bills to the fake bill receptacle is also conceivable, but in that case, transactions cannot be performed while transactions by the automated cash transaction machine are suspended, so this ends up significantly comprising customer convenience.

In contrast to this, the automated cash transaction machine 1 is configured to display on the operation display unit 6 the serial number of a currency bill determined to be a counterfeit bill by the discriminating unit 18, print the serial number on the "counterfeit bill detected" receipt RF1, and deliver the "counterfeit bill detected" receipt RF1 to the customer from the receipt issuing slot 8 serving as a medium delivery unit. Because of this, in the automated cash transaction machine 1, the person-in-charge selects from the currency bills fed into the fake bill receptacle 28 the currency bill on which is printed the serial number printed on the "counterfeit bill detected" receipt RF1 carried by the customer, so that the person-in-charge can without fail remove the currency bill deposited by that customer.

Furthermore, the automated cash transaction machine 1 is configured to store and save the serial number in the journal information JI in the journal unit 32 serving as a serial number recording unit. Because of this, in the automated cash transaction machine 1, even in a case where the customer has lost the "counterfeit bill detected" receipt RF1, the person-in-charge can, by referencing the journal information JI in the journal unit 32, reliably remove the currency bill deposited by the customer.

Moreover, it becomes unnecessary to suspend transactions made by the automated cash transaction machine 1, so the automated cash transaction machine 1 can be prevented from becoming unable to be used during that time, and customer convenience can be improved.

According to the above configuration, the automated cash transaction machine 1 is disposed with the currency bill deposit/withdrawal unit 16 that accepts currency bills from outside, the discriminating unit 18 that discriminates the authenticity of the currency bills and also reads their serial numbers, and the receipt issuing slot 8 and the display operation unit 6 that present to a customer the serial number of a currency bill judged to be a counterfeit bill by the discriminating unit 18. Because of this, the automated cash transaction machine 1 can allow the transaction in which a counterfeit bill was input to be identified on the basis of the serial number of the counterfeit bill.

2. Second Embodiment

2-1. Configuration of Automated Cash Transaction Machine

As shown in FIG. 1 and FIG. 2, an automated cash transaction machine 101 according to a second embodiment is configured in the same way as the automated cash transaction machine 1 according to the first embodiment except that it has a control unit 112 of a currency bill deposit/withdrawal machine 110 that differs from the control unit 12 of the currency bill deposit/withdrawal machine 10.

Figure 10:
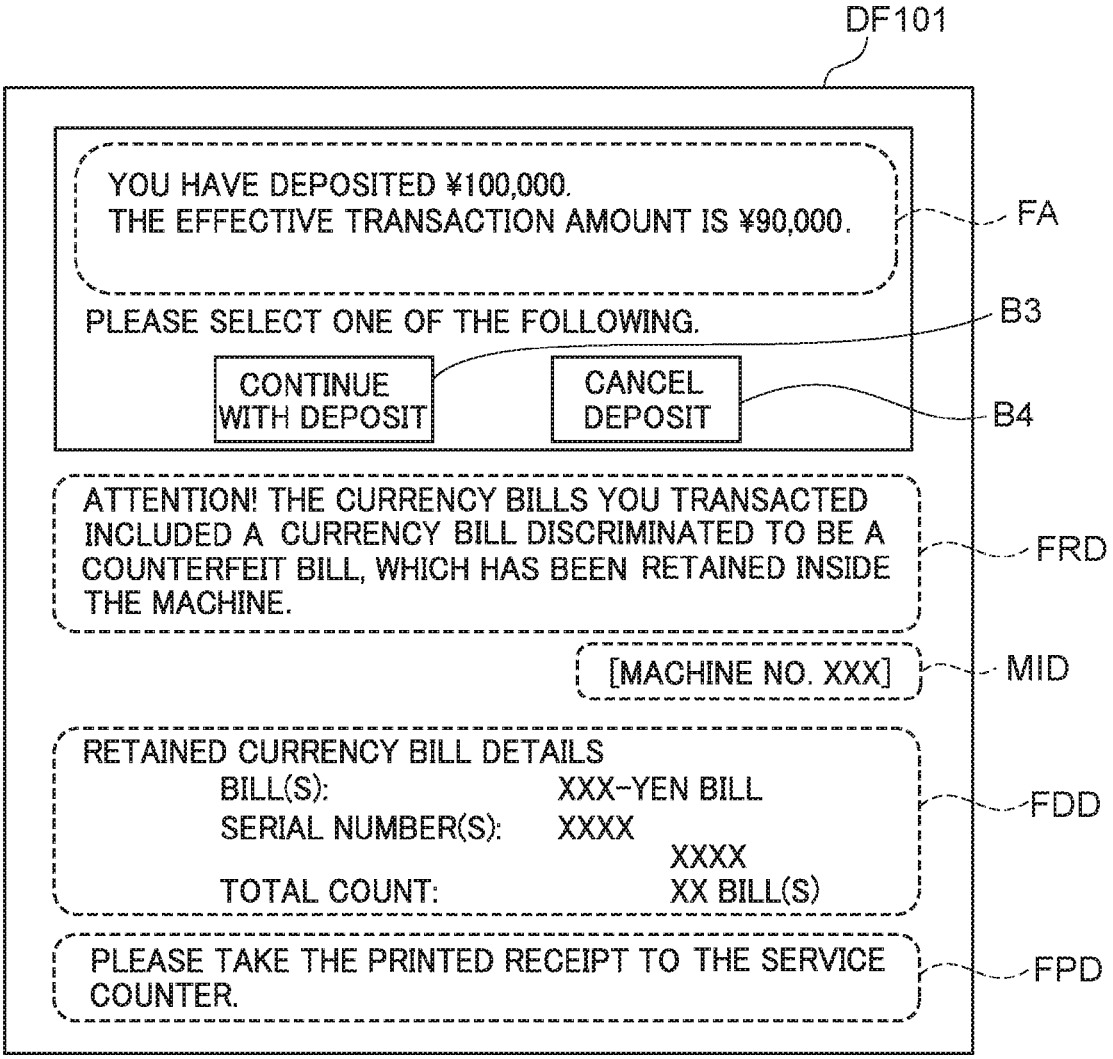
FIG. 10 is a schematic diagram showing a "counterfeit bill detected" display screen according to a second embodiment.
Figure 11:
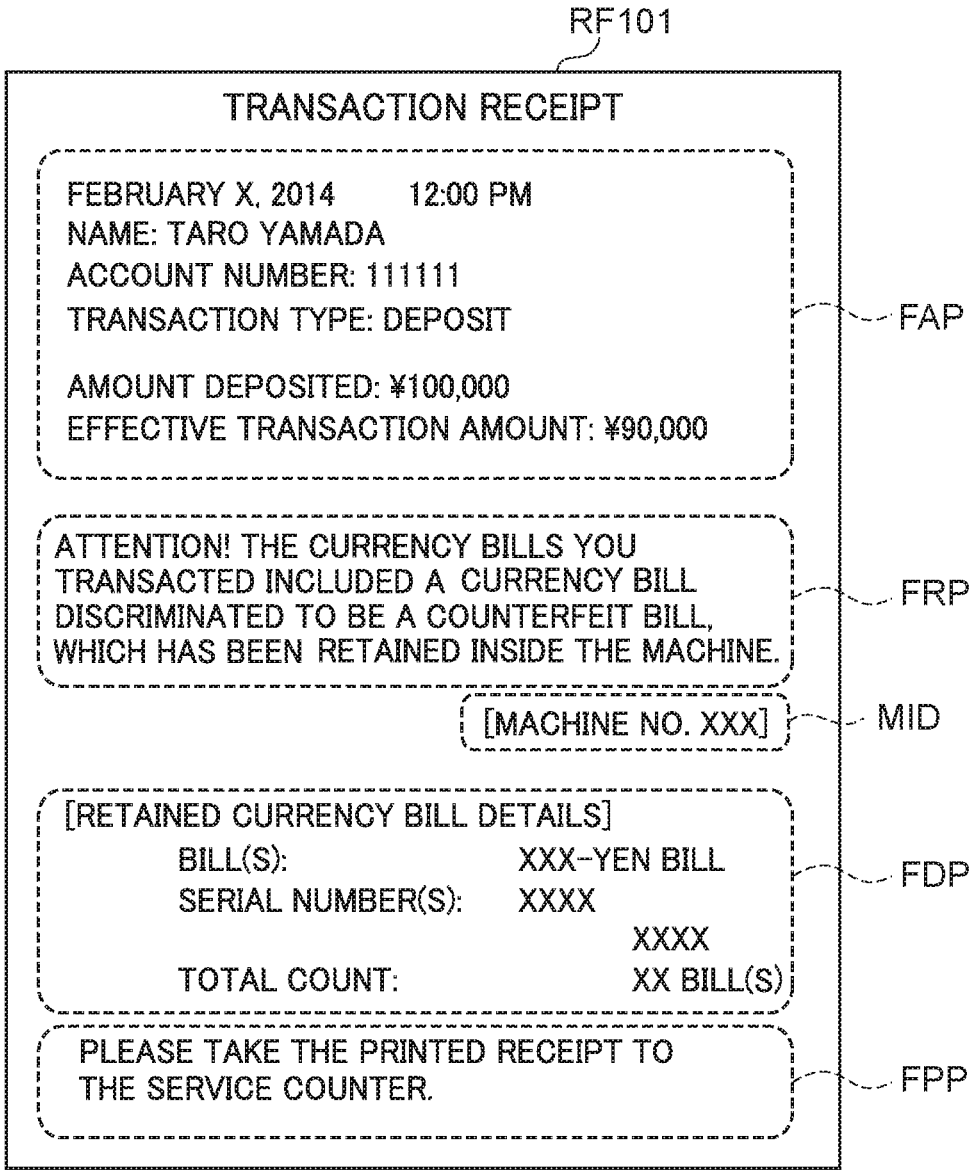
FIG. 11 is a schematic diagram showing a "counterfeit bill detected" receipt according to the second embodiment.
Figure 12:
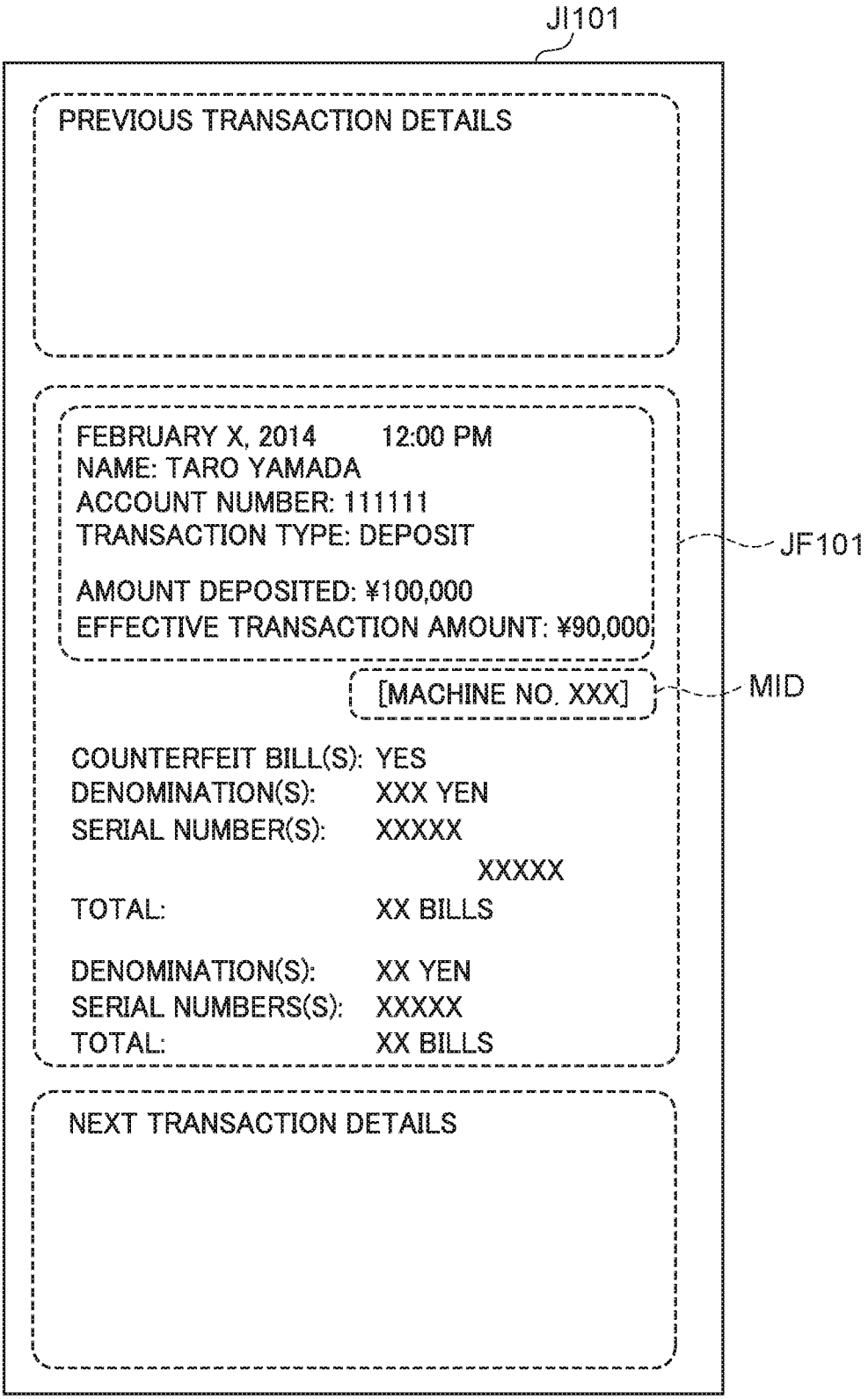
FIG. 12 is a schematic diagram showing journal information when a counterfeit bill is detected according to the second embodiment.

In the currency bill deposit/withdrawal machine 110, a "counterfeit bill detected" display screen DF101 shown in FIG. 10, a "counterfeit bill detected" receipt RF101 shown in FIG. 11, and "counterfeit bill detected" transaction details JF101 shown in FIG. 12 differ from the "counterfeit bill detected" display screen DF1 (FIG. 7), the "counterfeit bill detected" receipt RF1 (FIG. 8), and the "counterfeit bill detected" transaction details JF1 (FIG. 9), respectively, of the currency bill deposit/withdrawal machine 10.

The "counterfeit bill detected" display screen DF101 (FIG. 10), the "counterfeit bill detected" receipt RF101 (FIG. 11), and the "counterfeit bill detected" transaction details JF101 (FIG. 12) have a machine identification number MID serving as machine identification information added to them. The machine identification number MID is a unique serial number that is assigned to each automated cash transaction machine and identifies the automated cash transaction machine 101.

When the currency bill deposit/withdrawal machine 110 detects a counterfeit bill, it displays the machine identification number MID on the "counterfeit bill detected" display screen DF101 (FIG. 10), prints the machine identification number MID on the "counterfeit bill detected" receipt RF101 (FIG. 11), and stores the machine identification number MID in the "counterfeit bill detected" transaction details JF101 (FIG. 12). Because of this, in the currency bill deposit/withdrawal machine 110, even in a bank in which a plurality of the automated cash transaction machines 101 are installed, the person-in-charge can easily recognize the automated cash transaction machine 101 in whose fake bill receptacle 28 the currency bill judged to be a counterfeit bill is stored.

In addition, the automated cash transaction machine 101 according to the second embodiment achieves substantially the same action and effects as those of the automated cash transaction machine 1 according to the first embodiment.

3. Third Embodiment

3-1. Configuration of Automated Cash Transaction Machine

As shown in FIG. 1 and FIG. 2, an automated cash transaction machine 201 according to a third embodiment is configured in the same way as the automated cash transaction machine 1 according to the first embodiment except that it has a control unit 212 of a currency bill deposit/withdrawal machine 210 that differs from the control unit 12 of the currency bill deposit/withdrawal machine 10.

Figure 13:
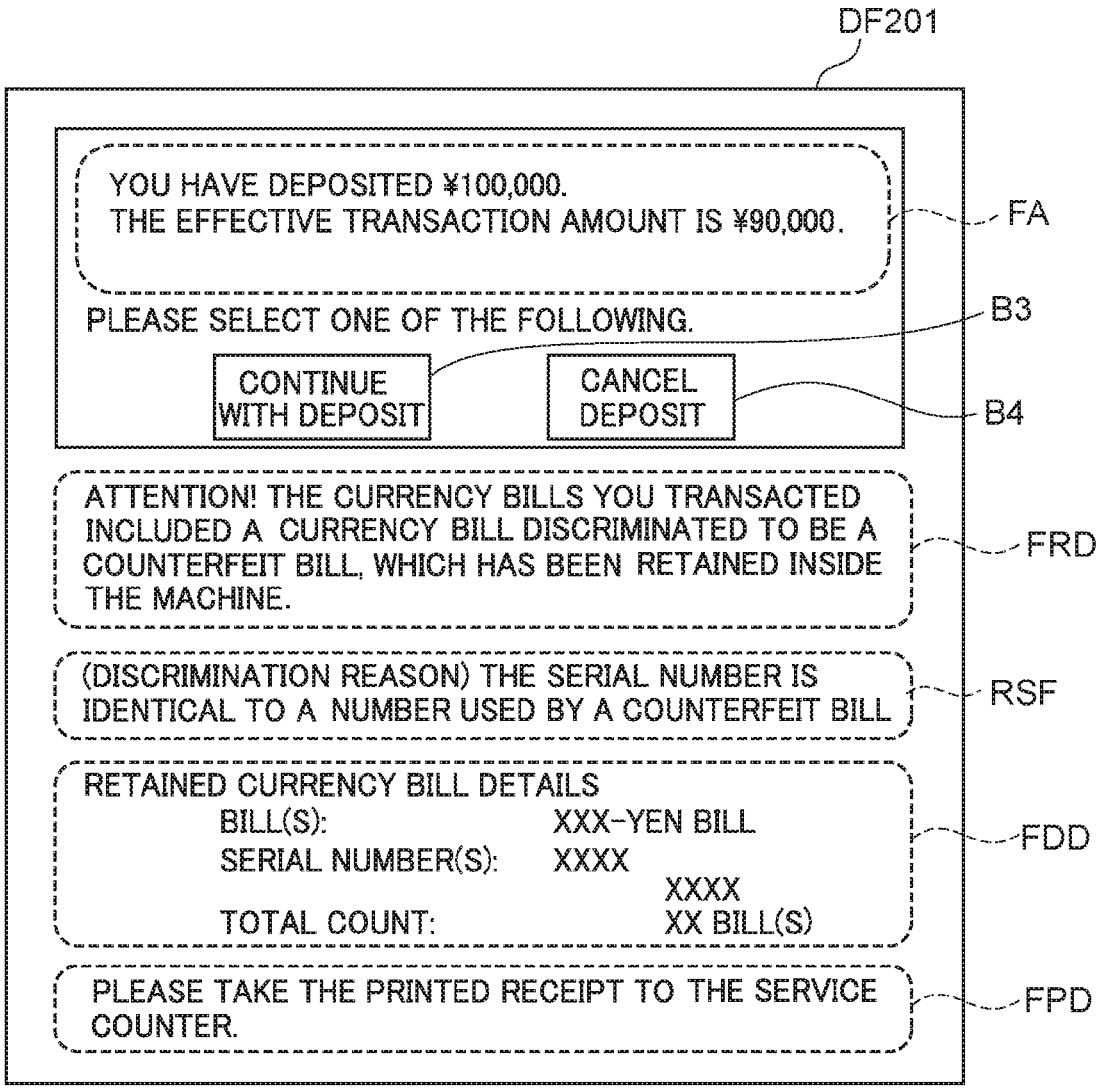
FIG. 13 is a schematic diagram showing a "counterfeit bill detected" display screen according to a third embodiment.
Figure 14:
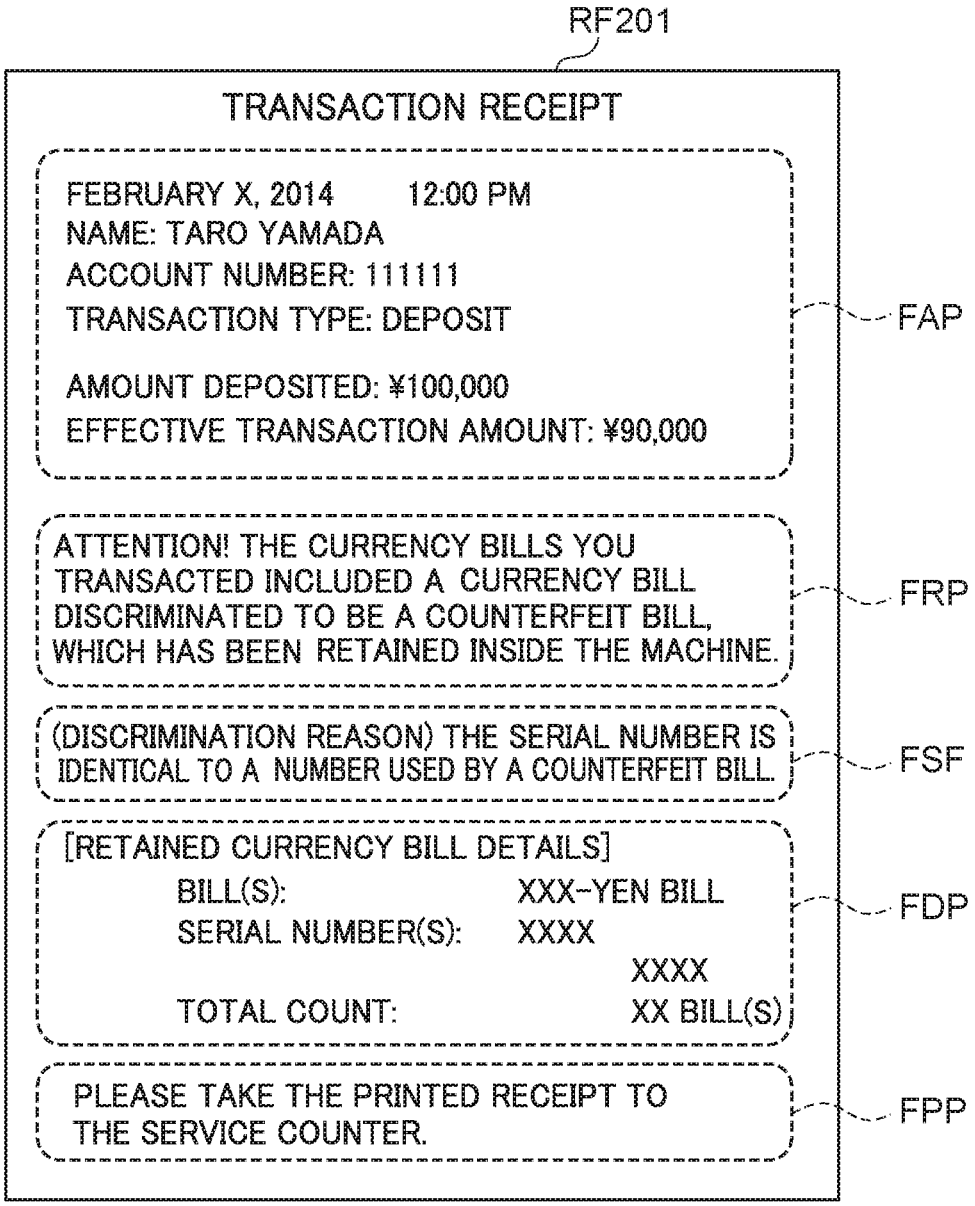
FIG. 14 is a schematic diagram showing a "counterfeit bill detected" receipt according to the third embodiment.
Figure 15:
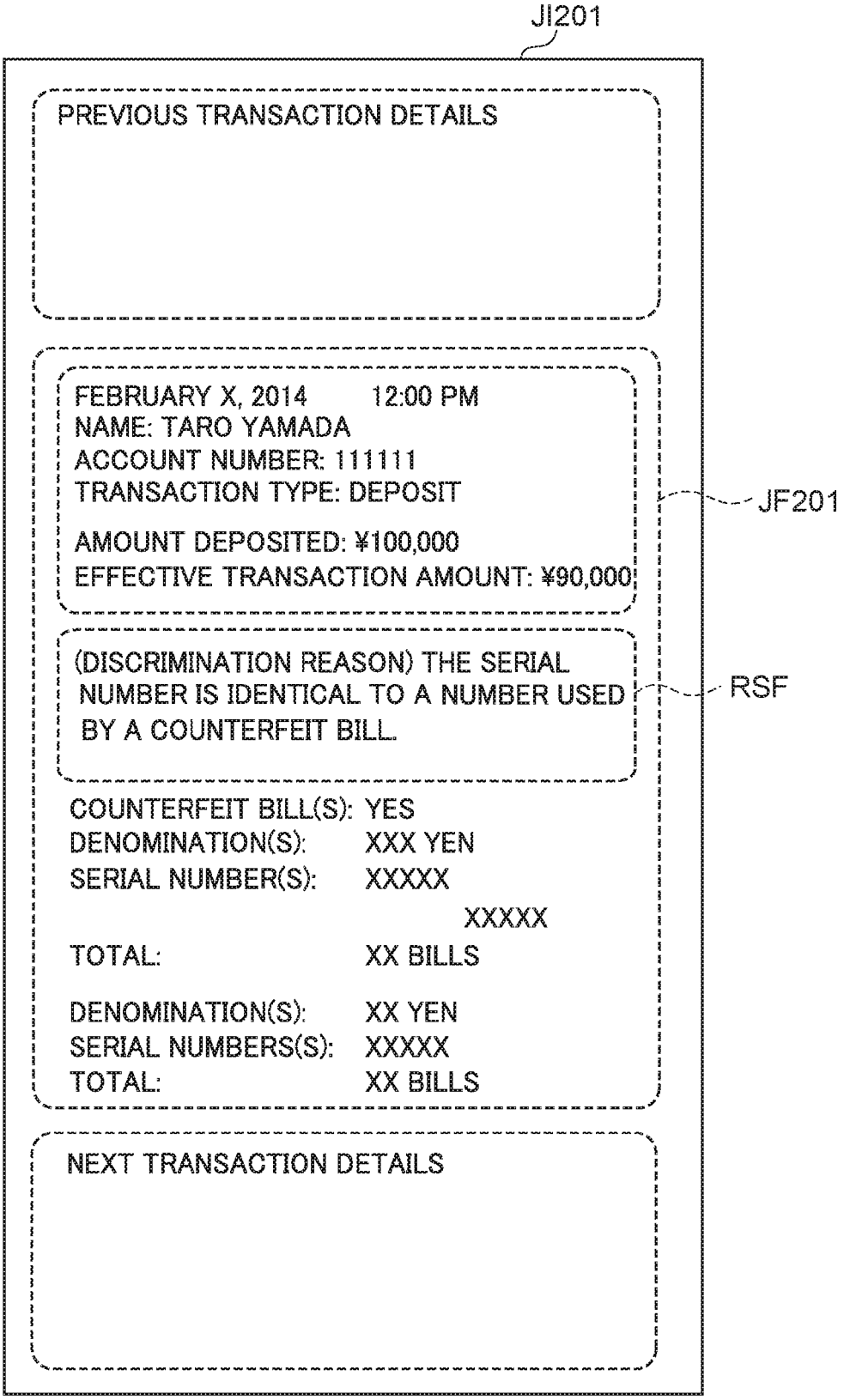
FIG. 15 is a schematic diagram showing journal information when a counterfeit bill is detected according to the third embodiment.

In the currency bill deposit/withdrawal machine 210, a "counterfeit bill detected" display screen DF201 shown in FIG. 13, a "counterfeit bill detected" receipt RF201 shown in FIG. 14, and "counterfeit bill detected" transaction details JF201 shown in FIG. 15 differ from the "counterfeit bill detected" display screen DF1 (FIG. 7), the "counterfeit bill detected" receipt RF1 (FIG. 8), and the "counterfeit bill detected" transaction details JF1 (FIG. 9), respectively, of the currency bill deposit/withdrawal machine 10.

The "counterfeit bill detected" display screen DF201 (FIG. 13), the "counterfeit bill detected" receipt RF201 (FIG. 14), and the "counterfeit bill detected" transaction details JF201 (FIG. 15) have a counterfeit bill judgment reason RSF added to them. The counterfeit bill judgment reason RSF is the reason why a currency bill was judged to be a counterfeit bill in the discriminating unit 18 of the automated cash transaction machine 201. Examples of the counterfeit bill judgment reason RSF include "The serial number is identical to a number used by a counterfeit bill" and "The currency bill does not have a security feature that it should have."

When the currency bill deposit/withdrawal machine 210 detects a counterfeit bill, it displays the counterfeit bill judgment reason RSF on the "counterfeit bill detected" display screen DF201 (FIG. 13), prints the counterfeit bill judgment reason RSF on the "counterfeit bill detected" receipt RF201 (FIG. 14), and stores the counterfeit bill judgment reason RSF in the "counterfeit bill detected" transaction details JF201 (FIG. 15). Because of this, in the currency bill deposit/withdrawal machine 210, when a person-in-charge explains to the customer the reason why a currency bill input by a customer was judged to be a counterfeit bill, the person-in-charge can use the counterfeit bill judgment reason RSF appearing on the "counterfeit bill detected" receipt RF201 as an aid. Furthermore, the customer can be convinced upon being presented with the reason why a currency bill that he/she input was judged to be a counterfeit bill.

In addition, the automated cash transaction machine 201 according to the third embodiment achieves substantially the same action and effects as those of the automated cash transaction machine 1 according to the first embodiment.

4. Other Embodiments

In the second embodiment described above, a case was described where a unique serial number assigned to each automated cash transaction machine 101 is used as the machine identification number MID. The present invention is not limited to this, and a management number for managing the automated cash transaction machine 101 in, for example, the bank in which the automated cash transaction machine 101 is installed may also be used as the machine identification number MID. The point is that it suffices for the person-in-charge to be able to recognize the automated cash transaction machine 101 in which the counterfeit bill is stored.

Furthermore, in the second embodiment described above, a case was described where the machine identification number MID is displayed on the "counterfeit bill detected" display screen DF101 (FIG. 10), printed on the "counterfeit bill detected" receipt RF101 (FIG. 11), and stored in the "counterfeit bill detected" transaction details JF101 (FIG. 12). The present invention is not limited to this, and it is alright if the machine identification number MID is not displayed on the "counterfeit bill detected" display screen DF101 or is not stored in the "counterfeit bill detected" transaction details JF101.

Moreover, in the third embodiment described above, a case was described where the counterfeit bill judgment reason RSF is displayed on the "counterfeit bill detected" display screen DF201 (FIG. 13), printed on the "counterfeit bill detected" receipt RF201 (FIG. 14), and stored in the "counterfeit bill detected" transaction details JF201 (FIG. 15). The present invention is not limited to this, and it is alright if the counterfeit bill judgment reason RSF is not displayed on the "counterfeit bill detected" display screen DF201 or is not stored in the "counterfeit bill detected" transaction details JF201.

Moreover, both the machine identification number MID and the counterfeit bill judgment reason RSF may be displayed on the "counterfeit bill detected" display screen, printed on the "counterfeit bill detected" receipt, and stored in the "counterfeit bill detected" transaction details.

Moreover, in the third embodiment described above, a case was described where the counterfeit bill judgment reason RSF is indicated in writing. The present invention is not limited to this, and the counterfeit bill judgment reason RSF may also be indicated, for example, by means of a code such as a symbol that the person-in-charge can recognize.

Moreover, in the embodiments described above, a case was described where the serial numbers are stored in the journal unit 32 disposed inside the housing 2 of the automated cash transaction machine 1, 101, or 201. The present invention is not limited to this, and the serial numbers may also be stored, for example, in a server connected via a local area network (LAN).

Moreover, in the embodiments described above, a case was described where the journal unit 32 stores the serial numbers in an electronic storage medium that is a hard disk. The present invention is not limited to this, and the journal unit 32 may also be configured to print the serial numbers on a paper medium.

Moreover, in the embodiments described above, a case was described where the discriminating unit 18 discriminates the currency bills and also reads their serial numbers. The present invention is not limited to this, and the device that discriminates the currency bills and the device that reads their serial numbers may also be mutually independent devices.

Moreover, in the embodiments described above, a case was described where the deposit process program stored beforehand in the storage unit 13 is read and executed. The present invention is not limited to this, and the deposit process program may also be acquired and executed from outside via an interface such as a universal serial bus (USB), a network such as Institute of Electrical and Electronics Engineers (IEEE) 802.3ab, or an external storage medium such as a compact disc read-only memory (CD-ROM).

Moreover, in the embodiments described above, a case was described where the present invention is applied to the automated cash transaction machine 1, 101, or 201 that transacts cash and uses the discriminating unit 18 to discriminate currency bills and determine whether or not the currency bills are counterfeit bills. The present invention is not limited to this and may also be applied to a variety of machines that discriminate thin paper-like media, such as gift certificates, cash vouchers, and admission tickets, and determine whether the media are normal or abnormal.

Furthermore, the present invention may also be applied to cash processing machines configured by a combination of multiple types of machines that perform a variety of processes relating to the transaction of currency bills and coins, such as currency bill deposit/withdrawal machines that accept and dispense currency bills and strapped small bundle payout machines that strap every predetermined number of currency bills.

Moreover, in the embodiments described above, a case was described where the present invention is applied to the automated cash transaction machine 1, 101, or 201 that performs deposit transactions and withdrawal transactions, but the present invention may also be applied to a machine that performs only deposit transactions.

Moreover, in the embodiments described above, a case was described where the automated cash transaction machine 1, 101, or 201 serving as a cash transaction machine is configured by the currency bill deposit/withdrawal unit 16 serving as a deposit unit, the discriminating unit 18 serving as a discriminating unit, the discriminating unit 18 serving as a serial number reading unit, and the receipt issuing slot 8 or the operation display unit 6 serving as a presentation unit. The present invention is not limited to this, and the cash transaction machine may also be configured by a deposit unit, a discriminating unit, a serial number reading unit, and a presentation unit having a variety of other configurations.

INDUSTRIAL APPLICABILITY

The present invention can be utilized in a variety of machines that discriminate currency bills, determine whether or not the currency bills are counterfeit bills, and read the serial numbers of the currency bills.

The disclosure of Japanese Patent Application No. 2012-231132 is incorporated in its entirety herein by reference.

All documents, patent applications, and technical standards mentioned in this specification are incorporated herein by reference to the same extent as if each individual document, patent application, or technical standard was specifically and individually indicated to be incorporated by reference.

The invention claimed is:

1. A cash transaction machine, comprising:

a deposit unit that accepts currency bills from outside;

a discriminating unit that judges the authenticity of the currency bills;

a serial number reading unit that reads the serial numbers of the currency bills;

a fake bill receptacle that stores the currency bill judged to be a fake bill by the discriminating unit, and does not store the currency bill judged to be a normal bill by the discriminating unit; and a presentation unit that presents, to a customer for each deposit transaction, the serial number of a currency bill judged to be a fake bill by the discriminating unit and information that the fake bill is stored in the cash transaction machine.

2. The cash transaction machine according to claim 1, wherein the presentation unit includes a display unit that displays the serial number of the currency bill judged to be a fake bill by the discriminating unit.

3. The cash transaction machine according to claim 1, wherein the presentation unit includes a printing unit that prints on a medium the serial number of the currency bill judged to be a fake bill by the discriminating unit and a medium delivery unit that delivers the medium to the customer.

4. The cash transaction machine according to claim 1, further comprising a serial number recording unit that records and saves the serial number of the currency bill judged to be a fake bill by the discriminating unit.

5. The cash transaction machine according to claim 4, wherein the serial number recording unit includes a storage unit that stores, in a predetermined electronic storage medium in the cash transaction machine, the serial number of the currency bill judged to be a fake bill by the discriminating unit.

6. The cash transaction machine according to claim 4, wherein the serial number recording unit includes a printing unit that prints on a paper medium the serial number of the currency bill judged to be a fake bill by the discriminating unit.

7. The cash transaction machine according to claim 4, wherein the serial number recording unit records and saves the serial number in a predetermined storage device disposed outside the cash transaction machine.

8. The cash transaction machine according to claim 1, wherein the presentation unit presents to the customer the serial number of the currency bill judged to be a fake bill by the discriminating unit, together with machine identification information that identifies the cash transaction machine.

9. The cash transaction machine according to claim 8, wherein the presentation unit further presents to the customer a reason why the currency bill was judged to be a fake bill.

10. The cash transaction machine according to claim 8, wherein the presentation unit includes a printing unit that prints on a medium the machine identification information and a medium delivery unit that delivers the medium to the customer.

11. The cash transaction machine according to claim 1, wherein the presentation unit presents to the customer the serial number of the currency bill judged to be a fake bill by the discriminating unit, together with a reason why the currency bill was judged to be a fake bill.

12. The cash transaction machine according to claim 11, wherein the presentation unit includes a printing unit that prints on a medium the reason why the currency bill was judged to be a fake bill and a medium delivery unit that delivers the medium to the customer.

13. The cash transaction machine according to claim 11, further comprising a serial number recording unit that records the serial number of the currency bill judged to be a fake bill by the discriminating unit, together with the reason why the currency bill was judged to be a fake bill.

14. The cash transaction machine according to claim 1, wherein the presentation unit presents information that the fake bill is separated from the normal bill and is stored in the fake bill receptacle.

15. The cash transaction machine according to claim 1, wherein the presentation unit presents a total amount of the currency bills deposited by the customer, including an amount of the fake bill, and an amount of the normal bill, the amount of the normal bill being an effective transaction amount.

16. The cash transaction machine according to claim 15, wherein when the discriminating unit judges that the currency bill is a fake bill, the presentation unit presents information for prompting the customer to go to a service counter.

17. The cash transaction machine according to claim 1, wherein when the deposit transaction is cancelled, the normal bill is returned and the fake bill is not returned.

18. A cash transaction machine, comprising:

a deposit unit that accepts currency bills from outside;

a discriminating unit that judges the authenticity of the currency bills;

a serial number reading unit that reads the serial numbers of the currency bills; and a presentation unit that presents, to a customer for each deposit transaction, the serial number of a currency bill judged to be a fake bill by the discriminating unit, a total amount of the currency bills deposited by the customer, including an amount of the fake bill, and an amount of the normal bill, the amount of the normal bill being an effective transaction amount.

* * * * *